US007290415B2

(12) United States Patent
Rosenberg et al.

(10) Patent No.: US 7,290,415 B2
(45) Date of Patent: Nov. 6, 2007

(54) DOOR LOCK

(75) Inventors: Avron S. Rosenberg, Golden Valley, MN (US); Matt Prazenka, Northbrook, IL (US)

(73) Assignee: Cargo Protectors, Inc., Minneapolis, MN (US)

( * ) Notice: Subject to any disclaimer, the term of this patent is extended or adjusted under 35 U.S.C. 154(b) by 0 days.

(21) Appl. No.: 11/124,801

(22) Filed: May 9, 2005

(65) Prior Publication Data

US 2005/0247084 A1 Nov. 10, 2005

Related U.S. Application Data

(60) Provisional application No. 60/569,580, filed on May 10, 2004.

(51) Int. Cl.
*E05B 37/06* (2006.01)

(52) U.S. Cl. ..... 70/9; 70/34; 70/54; 70/56

(58) Field of Classification Search ..... 70/2–13, 70/23, 32–34, 54–56
See application file for complete search history.

(56) References Cited

U.S. PATENT DOCUMENTS

| | | | | |
|---|---|---|---|---|
| 165,741 | A * | 7/1875 | Lockwood | 70/32 |
| 1,274,051 | A * | 7/1918 | Jacobson et al. | 70/4 |
| 1,866,955 | A * | 7/1932 | Terrill | 70/6 |
| 2,660,872 | A * | 12/1953 | Beach | 70/6 |
| 3,769,821 | A | 11/1973 | Randel | |
| 3,820,360 | A * | 6/1974 | Best | 70/32 |
| 3,901,058 | A * | 8/1975 | Best | 70/32 |
| 4,026,132 | A * | 5/1977 | Best | 70/9 |
| 4,866,960 | A * | 9/1989 | Brower | 70/56 |
| 5,172,574 | A * | 12/1992 | Perfetto | 70/56 |
| 5,669,255 | A * | 9/1997 | Albano | 70/56 |
| 5,946,952 | A * | 9/1999 | Mintchenko | 70/32 |
| 6,766,671 | B2 * | 7/2004 | Haczynski et al. | 70/23 |
| 2004/0011092 | A1 * | 1/2004 | Haczynski et al. | 70/23 |

OTHER PUBLICATIONS

Five (5) Pictures of Prototype Hasp, *Cargo Protectors, Inc.* v *American Lock Company*, Court File No. 00-CV-284 ADM/AB, no date.

Heavy Duty Hasps, American Lock Price List, May 2000, p. 28.

Commercial Grade Padlock, no date.

Commercial Grade Security to Match Pro Series® Padlocks, Master Lock Catalog, 2001, p. 10.

* cited by examiner

*Primary Examiner*—Suzanne Dino Barrett
*Assistant Examiner*—Christopher Boswell
(74) *Attorney, Agent, or Firm*—Patterson, Thuente, Skaar & Christensen, P.A.

(57) ABSTRACT

A puck shaped lock including a substantially cylindrical body into which a cavity is formed and a movable bolt that passes through the cavity and is shiftable from a first position advanced across the cavity to a second position substantially withdrawn from the cavity and which can be releasably secured across the cavity fixedly connected to and extending from the puck shaped lock and being securable to a door or a door jamb. The invention further includes a hasp member supporting a first staple securable to a door or a doorjamb. When the puck shaped lock is positioned overlying the hasp member the staple is inserted into the cavity and the movable bolt can be advanced across the cavity and through the opening in the staple whereby the puck shaped lock and the hasp member are secured together and the door is locked.

19 Claims, 5 Drawing Sheets

DOOR LOCK

CLAIM TO PRIORITY

This application claims priority to U.S. Provisional Application Ser. No. 60/569,580 filed May 10, 2004 and entitled "Door Lock." That application is incorporated herein in its entirety by reference.

FIELD OF THE INVENTION

The invention generally relates to the field of door locks. More particularly, the invention relates to heavy duty hasp locks, commonly used for securing swinging doors on delivery trucks and the like.

BACKGROUND OF THE INVENTION

A large portion of products sold in commerce in the United States is transported by truck. Consequently, theft from delivery vans, trucks and storage facilities is a serious concern. Locks that are generally provided by the manufacturers of delivery trucks and trailers used on semi-trailers are often inadequate to resist the assault of a determined thief who intends to break into the van, truck or trailer to steal the products therein. Thus, it is common in the industry to use high strength hasps and locks to provide additional protection against breaking and entering and theft from trucks and storage facilities.

An exemplary high strength hasp for use with a puck type lock is depicted in FIG. 1. A puck type lock is a non-conventional type of padlock originally invented for use in protecting cabinets of vending machines. A puck lock includes a flat generally cylindrical housing that defines a slot shaped trough or channel extending into one of the flat faces of the housing. A slot or channel is adapted to accept the staple portions of a hasp within. The puck lock further includes a bolt which can slide across the trough or channel and through the openings in the staple portions in the hasp to secure the staples together. The obvious advantage of a puck lock is that it does not have an exposed U-shaped shackle as does a conventional padlock. The internal bolt that passes through the staples is entirely enclosed in a heavy protective housing. Therefore, a puck lock provides greater protection from efforts to cut the shackle to gain access to the contents of the protected structure than does a conventional padlock.

Determined thieves can still attack portals secured with puck locks, however. If the puck lock is placed onto a conventional hasp the hasp can sometimes be broken by prying the hasp from the door, hammer blows or gripping the puck lock with a large pipe wrench or other tool and twisting the puck lock to separate the staples from the hasp. Thus, special high strength hasps with protective features have been developed.

Referring to FIG. 1, a prior art high strength hasp includes two plates that can be secured to two panels of a door or a door and doorjamb. Each plate supports a hasp staple, the two of which are opposed so that, when the door is closed, openings in the staples are aligned so that the bolt of a puck type lock or the shackle of a padlock may pass through them to lock together the two halves of the hasp. The high strength hasp also includes a protective partial ring that is sized and shaped to at least partially surround the periphery of a puck type lock to provide additional protection against the lock being forced open by thieves. The partial ring shaped protector is sized to fit closely about the perimeter of a puck type lock. The ring must fit closely to provide good protection. Otherwise, prying tools can be inserted into the space between the ring and the puck lock to pry in an attempt to break the hasp.

Since it is necessary for the ring shaped protector to fit snugly around the puck lock, problems arise. A puck lock can weigh several pounds. It becomes difficult and awkward for an operator firmly grasp the relatively heavy puck lock to insert the it inside the protective ring without pinching fingers. Further, if the puck-shaped lock is dropped there is a significant risk of injury to the operator's feet or of damage to merchandise that the lock may drop onto because of the substantial mass of the puck lock.

Further still, a loose puck lock is readily stolen or lost. When the delivery van or truck doors are opened the puck-shaped lock must be set aside somewhere and it is easy for the operator to forget to return the puck-shaped lock to the closed doors and leave it behind at a delivery location. Lastly, sometimes the operator will simply forget to put the puck-shaped lock on to lock the doors when departing. Often the puck lock is placed on the bumper or tailgate of the van and forgotten. The puck lock then falls from the truck en route and is lost.

SUMMARY OF THE INVENTION

The present invention substantially solves the above-discussed problems by providing a high-strength hasp with a puck-shaped lock secured to one-half of the hasp. This prevents theft of the puck lock and makes it far less likely that an operator will fail or forget to lock the door to the van, truck or trailer before leaving it.

Referring to FIG. 2, the puck-shaped lock is secured to the right hand half of the hasp. In this way the invention prevents loss of the puck-shaped lock, eases it's application to the hasp to provide locking, while reducing the possibility of fingers being pinched while trying to insert the puck-shaped lock into the protective ring. In addition, the invention eliminates the problem of injury or property damage when a lock is dropped by making the lock undroppable. The invention also increases the probability that the lock will be properly secured by an operator or driver.

DETAILED DESCRIPTION OF THE INVENTION

Figure 1:
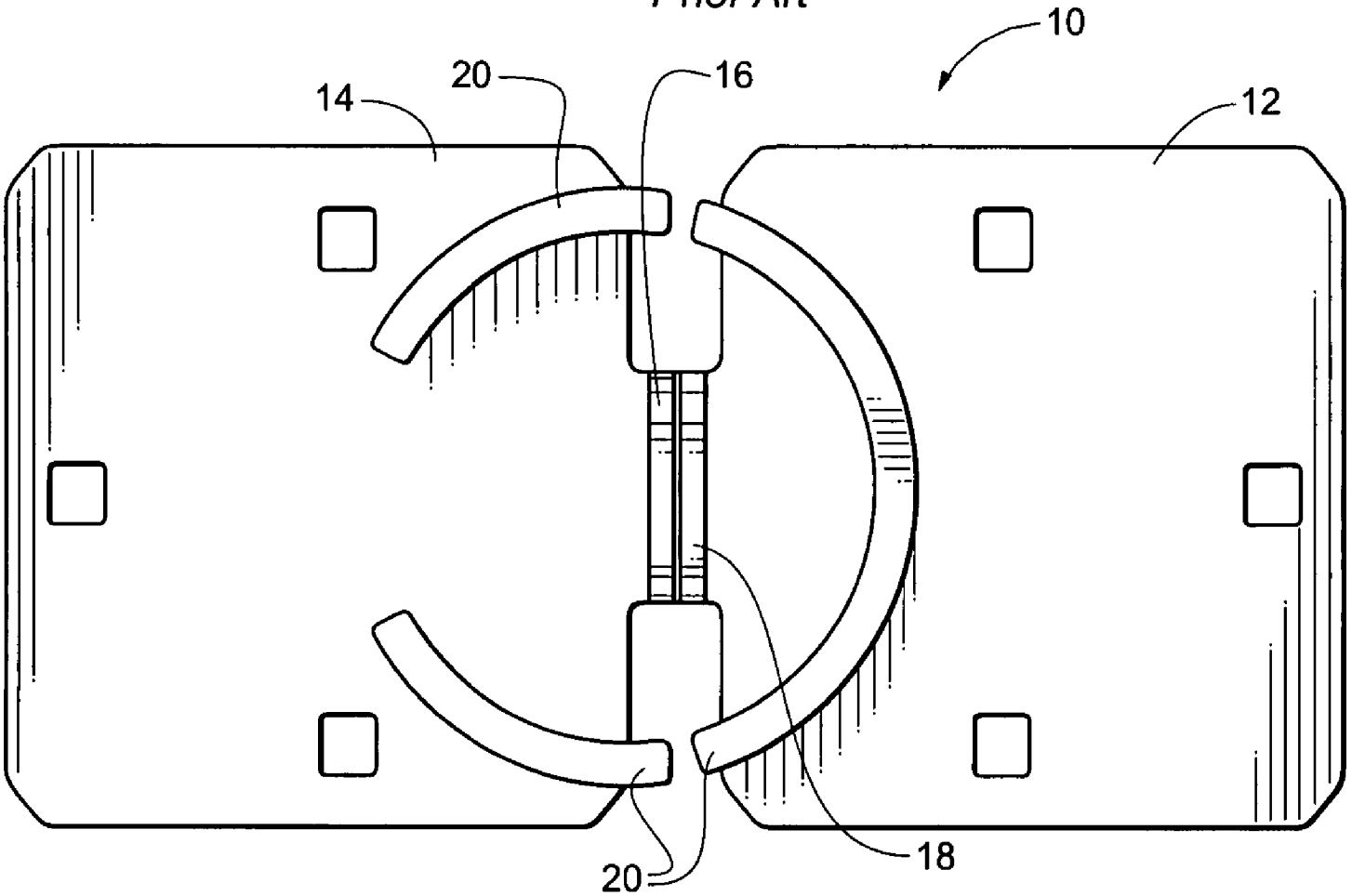
Fig. 1 Prior Art
FIG. 1 is a front plan view of a prior art high-strength hasp with protecting ring.

Referring to FIG. 1 a prior art high strength hasp 10 generally includes a right plate 12, a left plate 14, a first staple 16, second staple 18 and a protective ring 20.

Figure 2:
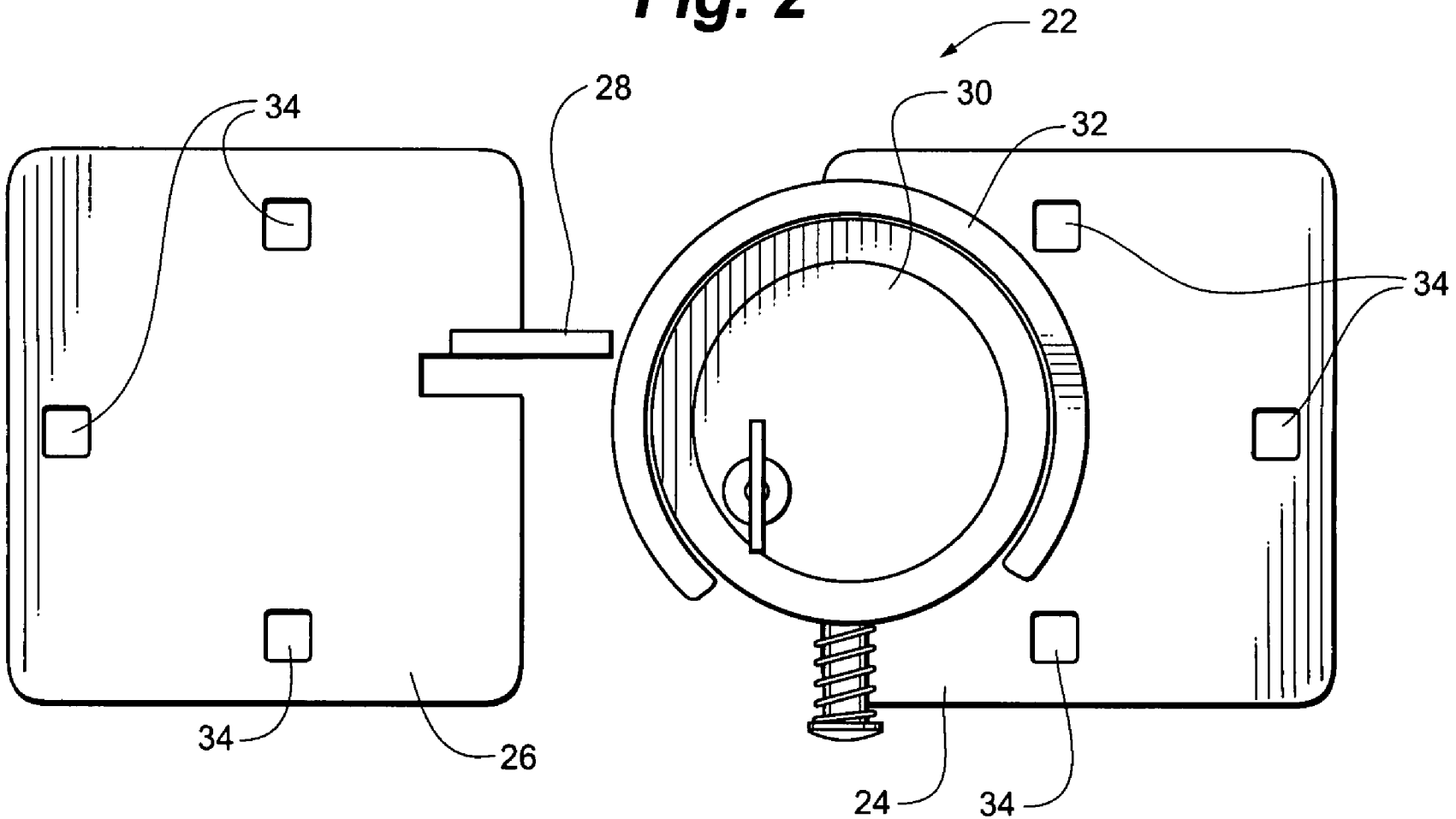
FIG. 2 is a front elevational view of the present invention with the halves of the hasp separated and the locking mechanism unlocked.

Referring to FIG. 2, an embodiment of the integrated hasp lock 22 of the present invention generally includes right plate 24, left plate 26, first staple 28, puck lock 30 and protective ring 32.

Right plate 24 may be any shape or size but it is desirably generally quadrilateral in shape. Right plate 24 defines several mounting holes 34 proportioned to receive mounting bolts (not shown) though plates may be mounted in other ways known to those skilled in the art.

In the depicted embodiment, right plate 24 also supports protective ring 32. Protective ring 32 is desirably secured to right plate 24 by welding or other high strength attachment. Protective ring 32 may also be integrally formed with right plate 24. In other embodiments of the invention, protective ring 32 maybe attached to left plate 26 or may be segmented so that a portion of it is attached to right plate 24 and a portion to left plate 26 as is protective ring 20 depicted in FIG. 1.

Left plate 26 is generally a mirror image of right plate 24. However, left plate 26, in this embodiment, does not support any portion of protective ring 32. Though, as indicated above, left plate 26 may support all or a part of protective ring 26. Left plate 26 also includes first staple 28 integrally attached thereto as by welding or forming as a bent structure.

Puck lock 30 may be but is not limited to a conventional puck lock generally as described in U.S. Pat. No. 3,769,821 issued to Randel. Puck lock 30 may also be any type of padlock that does not have an exposed U-shaped shackle.

Figure 5:
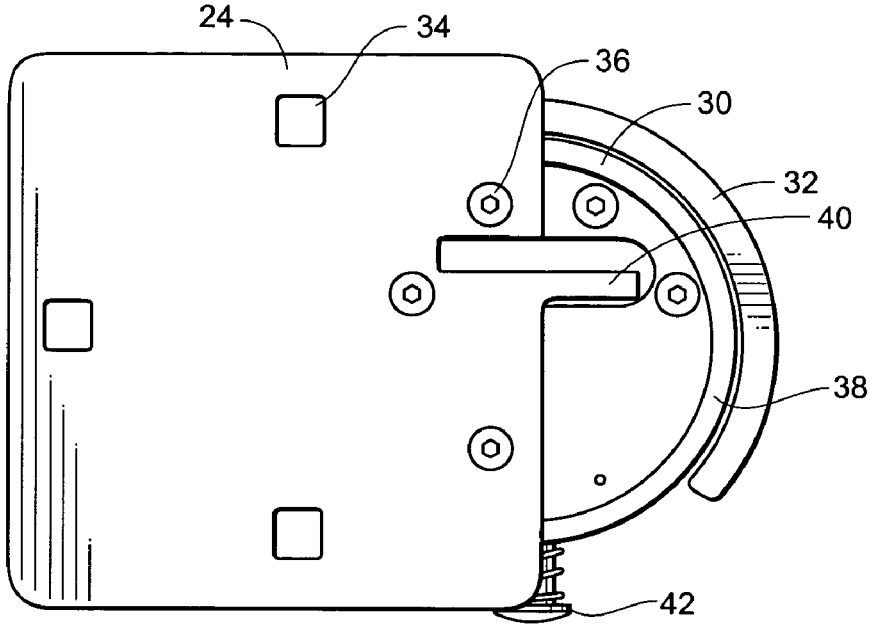
FIG. 5 is a rear elevational view of an embodiment of the present invention depicting half of the hasp with the locking mechanism secured thereto.

Puck lock 30 is secured to right plate 24 or left plate 26. Referring now to FIG. 5, puck lock 30 may be secured to right plate 24 by mounting screws 36. In another embodiment of the invention the housing 38 of puck lock 30 may be attached to right plate 24 such as by welding. Alternately, puck lock 30 may be secured to protective ring 32 such as by welding.

In another embodiment of the invention, protective ring 32 may be dispensed with and puck lock 30 may have its housing 38 secured directly to the front surface of right plate 24 by, for example welding. In this case, the connection between housing 38 and right plate 24 or left plate 26 should be highly resistant to rotation of puck lock 30.

Referring to FIG. 5, right plate 24 may include a second staple 40. This configuration provides additional strength to the locking action provided by integrated hasp lock 22 in that bolt 42 of puck lock 30 passes through both first staple 28 and second staple 40 in addition to the housing 38 of puck lock 30 being secured to right plate 24.

Figure 6:
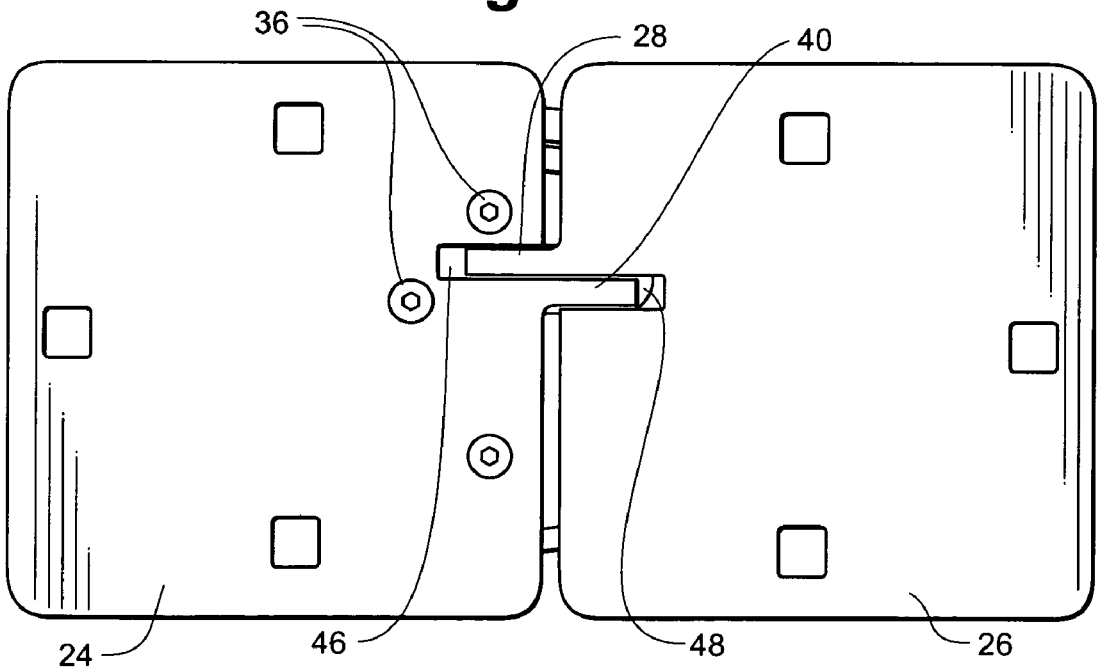
FIG. 6 is a rear elevational view of an embodiment of the present invention with the two halves of the hasp locked together.
Figure 7:
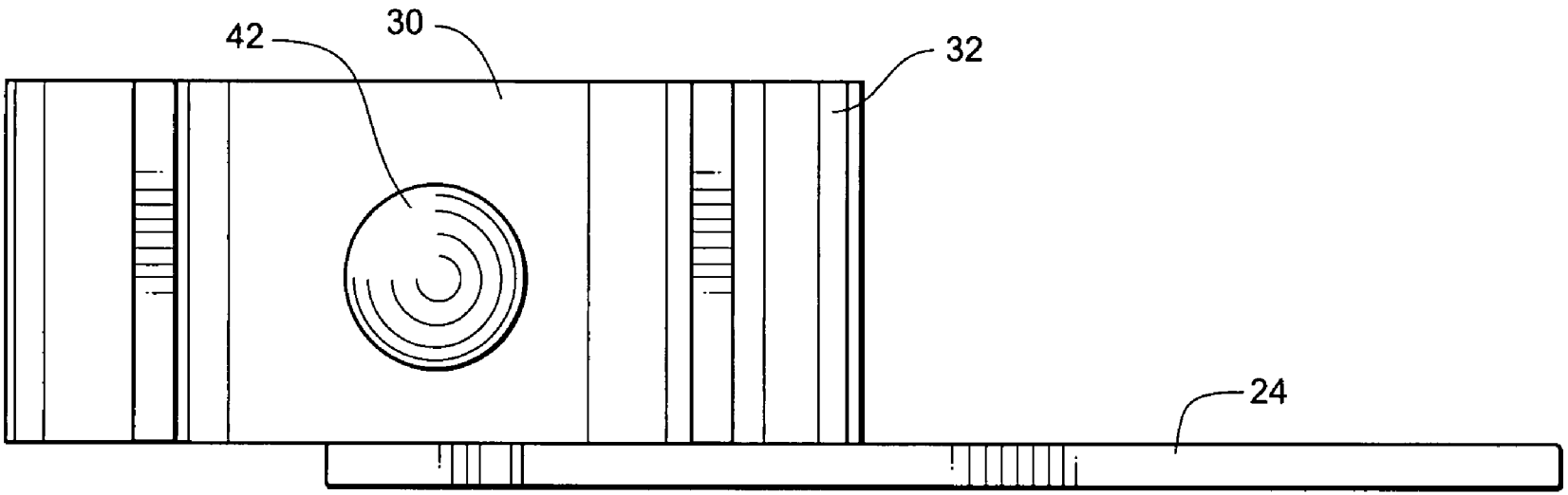
FIG. 7 is a bottom plan view of an embodiment of the present invention showing the locking mechanism securely attached to the hasp.

Referring to FIGS. 5 and 6, first staple 28 and/or second staple 40 may extend outwardly from the perimeter 44 of right plate 24 and left plate 26 respectively. In addition, right plate 24 and/or left plate 26 may present notches 46, 48 respectively which are dimensioned to receive first staple 28 and second staple 40 respectively. This arrangement increases the resistance of right plate and left plate to breakage or separation by prying.

Figure 3:
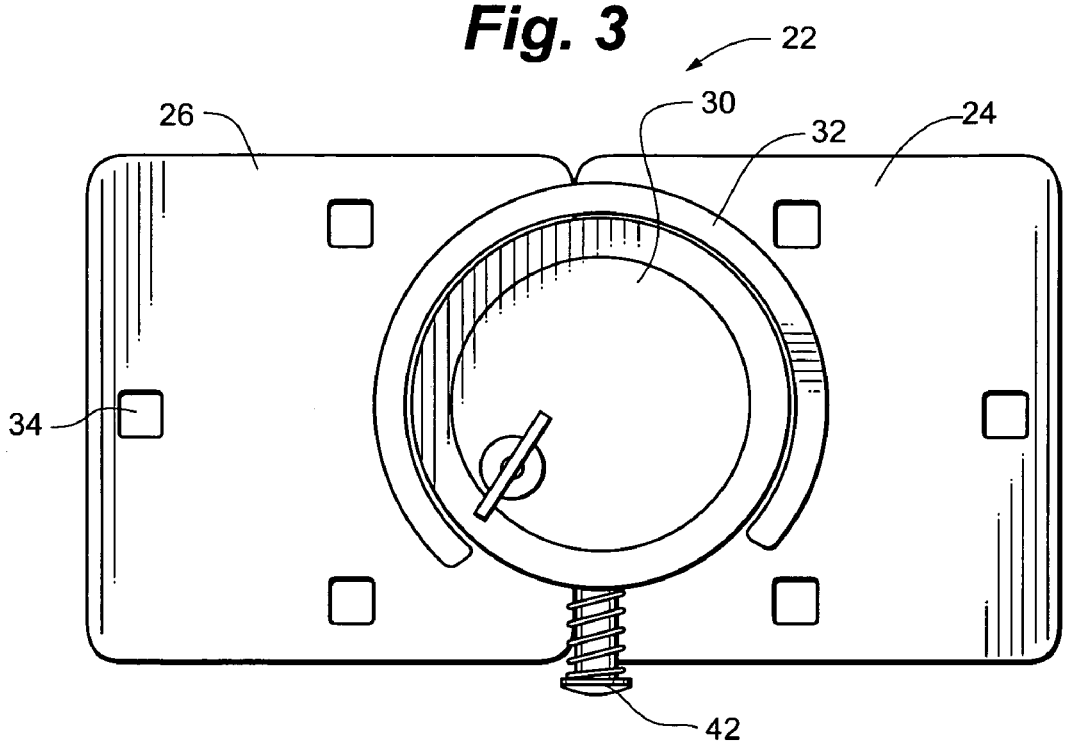
FIG. 3 is a front elevational view of the embodiment of the present invention with the two halves of the hasp joined and the locking mechanism unlocked.
Figure 4:
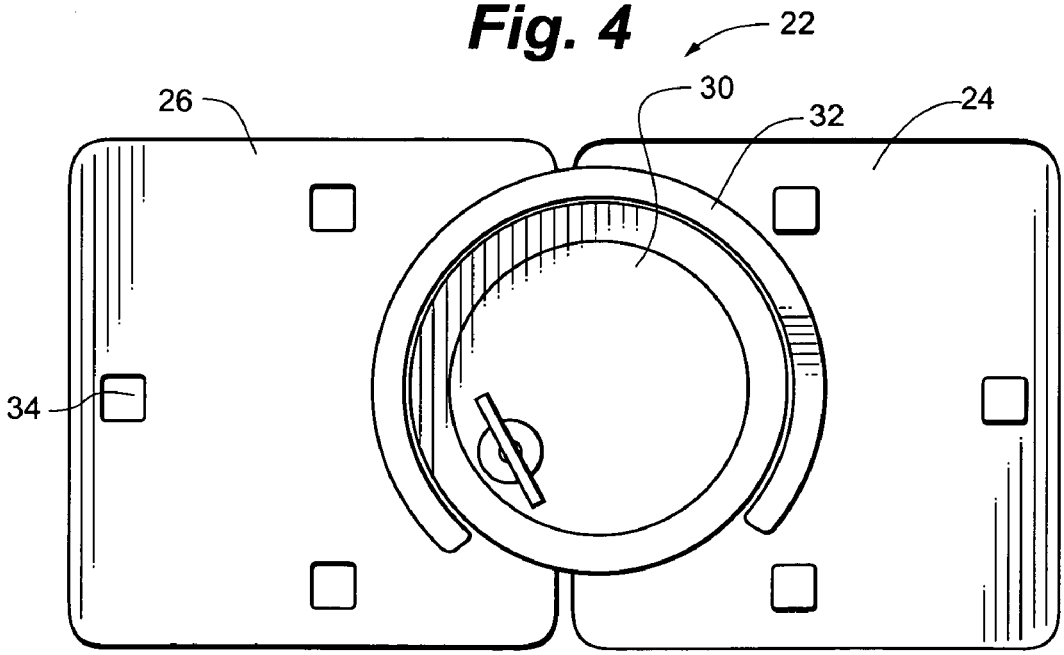
FIG. 4 is a front elevational view of the embodiment of the present invention with the two halves of the hasp joined and the locking mechanism locked.

In operation, referring to FIG. 2, right plate 24 and left plate 26 are secured respectively to two panels of a door. Alternately, right plate 24 or left plate 26 may be secured to a door while the other of right plate 24 and left plate 26 is secured to a doorjamb. For the purposes of this application references to a pair of doors or a door and a doorjamb should be considered to be interchangeable. With puck lock 30 in the unlocked position, right plate 24 is brought into opposition with left plate 26 as depicted in FIG. 3. Then bolt 42 of puck lock 30 is advanced into puck lock 30 so that bolt 42 secures to at least the first staple 28. In an embodiment of the invention including first staple 28 and second staple 40, bolt 42 passes through both first staple 28 and second staple 40. The locked position of puck lock 30 is depicted in FIG. 4.

FIG. 6 depicts an embodiment of integrated hasp lock 22 showing how first staple 28 and second staple 40 are brought into opposition so that bolt 42 may pass through both of them. FIG. 6 also depicts the interdigitation of first staple 28 into notch 46 and of second staple 40 into notch 48. The positioning of first staple 28 into notch 46 and of second staple 40 into notch 48 serves to keep right plate 24 aligned with left plate 26. This relationship helps integrated hasp lock 22 resist attempts to break it by prying or twisting.

The present invention may be embodied in other specific forms without departing from the central attributes thereof, therefore, the illustrated embodiments should be considered in all respects as illustrative and not restrictive, reference being made to the appended claims rather than the foregoing description to indicate the scope of the invention.

What is claimed is:

1. A locking assembly comprising:

a first member supporting a first staple defining an opening therethrough, the first member being securable to a door or a doorjamb;

a second member securable to a door or a doorjamb;

a puck shaped lock substantially immovably fixed to the second member by structure separate from a locking mechanism, the puck shaped lock comprising a substantially cylindrical body into which a cavity is formed and the locking mechanism comprising a movable bolt that passes through the cavity and is shiftable from a first position advanced across the cavity to a second position substantially withdrawn from the cavity and which can be releasably secured across the cavity such that when the first member and the second member are brought into an adjacent position the staple can be inserted into the cavity and the movable bolt can be advanced across the cavity and through the opening in the staple whereby the first member and the second member are secured together and the door is locked; and in which the first member and the second member meet at a straight line closely apposed border that is substantially parallel to a path of travel of the movable bolt when the movable bolt is shifted from the first position to the second position, the straight line closely apposed border including a first portion of the first member located on a first side of the staple and a second portion of the first member location on a second side staple, the first portion and the second portion being disposed on the same plane that dissects the locking assembly into the first member and the second member.

2. The locking assembly as claimed in claim 1, in which the second member further comprises a second staple defining an opening and in which the puck shaped lock is substantially immovably fixed to the second member such that the second staple is located within the cavity and the bolt is aligned to pass through the opening in the second staple.

3. The locking assembly as claimed in claim 1, further comprising a protective ring.

4. The locking assembly as claimed in claim 3, in which the protective ring is continuous and fixedly attached to the second member.

5. The locking assembly as claimed in claim 3, in which the protective ring is segmented and a first portion of the protective ring is fixedly attached to the first member and a second portion of the protective ring is fixedly attached to the second member.

6. The locking assembly as claimed in claim 1, in which the first staple extends at least partially outwardly beyond a perimeter of the first member and overlaps the second member or extends into a slot formed into the second member when the first member and the second member are brought into opposition.

7. A method of manufacturing a locking assembly, comprising the step of:

forming a first member supporting a first staple defining an opening therethrough, the first member being securable to a door or a doorjamb;

forming a second member securable to a door or a doorjamb;

attaching a puck shaped lock such that it is substantially immovably fixed by structure separate from a locking mechanism to the second member, the puck shaped lock comprising a substantially cylindrical body into which a cavity is formed and the locking mechanism comprising a movable bolt that passes through the cavity and is shiftable from a first position advanced across the cavity to a second position substantially withdrawn from the cavity and which can be releasably secured across the cavity such that when the first member and the second member are brought into an adjacent position the staple can be inserted into the cavity and the movable bolt can be advanced across the cavity and through the opening in the staple whereby the first member and the second member are secured together and the door is locked; and in which the first member and the second member meet at a straight line closely apposed border that is substantially parallel to a path of travel of the movable bolt when the movable bolt is shifted from the first position to the second position, the straight line closely apposed border including a first portion of the first member located on a first side of the staple and a second portion of the first member located on a second side staple, the first portion and the second portion being disposed on the same plane that dissects the locking assembly into the first member and the second member.

8. The method as claimed in claim 7, further comprising the steps of:

forming a second staple defining an opening on the second member; and positioning the puck shaped lock such that the second staple is located within the cavity and the bolt is aligned to pass through the opening in the second staple.

9. The method as claimed in claim 7, further comprising the steps of securing a protective ring such that the protective ring closely surrounds the puck shaped lock.

10. The method as claimed in claim 9, in which the protective ring is continuous and fixedly attached to the second member.

11. The method as claimed in claim 9, further comprising the steps of:

segmenting the protective ring;

fixedly attaching a first portion of the protective ring to the first member; and fixedly attaching a second portion of the protective ring to the second member.

12. The method as claimed in claim 7, further comprising the steps of:

forming the first staple such that it extends at least partially outwardly beyond a perimeter of the first member and overlaps the second member or extends into a slot formed into the second member when the first member and the second member are brought into apposition.

13. A lock assembly, comprising:

a puck shaped lock comprising a substantially cylindrical body into which a cavity is formed and a movable bolt that passes through the cavity and is shiftable from a first position advanced across the cavity to a second position substantially withdrawn from the cavity and which can be releasably secured across the cavity;

a mounting member fixedly connected to the puck shaped lock by structure separate from a locking mechanism and extending from the puck shaped lock and being securable to a door or a doorjamb;

a hasp member supporting a first staple defining an opening therethrough, the hasp member being securable to a door or a doorjamb;

such that when the puck shaped lock is positioned overlying the hasp member the staple is inserted into the cavity and the movable bolt can be advanced across the cavity and through the opening in the staple whereby the puck shaped lock and the hasp member are secured together and the door is locked; and in which the first member and the second member meet at a straight line closely apposed border that is substantially parallel to a path of travel of the movable bolt when the movable bolt is shifted from the first position to the second position, the straight line closely apposed border including a first portion of the first member located on a first side of the staple and a second portion of the first member located on a second side staple, the first portion and the second portion being disposed on the same plane that dissects the locking assembly into the first member and the second member.

14. The locking assembly as claimed in claim 13, in which the puck shaped lock further comprises a protective ring, the protective ring closely fitting around at least a portion of the perimeter of the puck shaped lock.

15. The locking assembly as claimed in claim 13, in which the mounting member further comprises a second staple defining an opening and in which the second staple is located within the cavity and the bolt is aligned to pass through the opening in the second staple.

16. The locking assembly as claimed in claim 13, protective ring having a first portion that is fixedly attached to the mounting member and a second portion that is fixedly attached to the hasp member.

17. A method of locking a door, comprising the steps:

securing a hasp member comprising a first staple presenting an opening therethrough to a door or doorjamb, the hasp member comprising a first member and a second member that meet at a substantially straight line closely apposed border that is parallel to a path of travel of a movable bolt when the movable bolt is shifted from the first position to the second position, the straight line closely apposed border including a first portion of the first member located on a first side of the staple and a second portion of the first member located on a second side staple, the first portion and the second portion being disposed on the same plane that dissects the locking assembly into the first member and the second member;

fixedly securing a puck shaped lock to a door by structure separate from a locking mechanism, the puck shaped lock comprising a substantially cylindrical body into which a cavity is formed and the locking mechanism comprising a movable bolt that passes through the cavity and is shiftable from a first position advanced across the cavity to a second position substantially withdrawn from the cavity and which can be releasably secured across the cavity;

closing the door such that the cavity of the puck shaped lock is superimposed over the staple and the staple is within the cavity such that the movable bolt is aligned with the opening; and advancing the movable bolt to pass through the opening and across the cavity whereby the puck shaped lock is releasably secured to the hasp member.

18. The method as claimed in claim 17, in which the puck shaped lock further comprises a continuous protective ring surrounding the puck shaped lock.

19. The method as claimed in claim 18, in which the protective ring is segmented.

* * * * *

UNITED STATES PATENT AND TRADEMARK OFFICE

CERTIFICATE OF CORRECTION

PATENT NO. : 7,290,415 B2
APPLICATION NO. : 11/124801
DATED : November 6, 2007
INVENTOR(S) : Avron S. Rosenberg et al.

It is certified that error appears in the above-identified patent and that said Letters Patent is hereby corrected as shown below:

Col. 2, Line 8, after “operator” insert -- to --

Col. 2, Line 9, after “insert” delete “the”

Col. 3, Line 21, delete “maybe”, insert -- may be --

Col. 6, Line 60, after “a”, delete “substantially”

Col. 6, Line 61, after “is”, insert -- substantially --

Signed and Sealed this

Twenty-second Day of July, 2008

JON W. DUDAS
*Director of the United States Patent and Trademark Office*